US011234507B2

(12) United States Patent
Cotton-Cantrell

(10) Patent No.: US 11,234,507 B2
(45) Date of Patent: Feb. 1, 2022

(54) CONVERTIBLE TOTE BAG ASSEMBLY AND METHOD THEREOF

(71) Applicant: April L. Cotton-Cantrell, McKinney, TX (US)

(72) Inventor: April L. Cotton-Cantrell, McKinney, TX (US)

( * ) Notice: Subject to any disclaimer, the term of this patent is extended or adjusted under 35 U.S.C. 154(b) by 453 days.

(21) Appl. No.: 16/204,600

(22) Filed: Nov. 29, 2018

(65) Prior Publication Data

US 2020/0170391 A1 Jun. 4, 2020

Related U.S. Application Data

(60) Provisional application No. 62/592,176, filed on Nov. 29, 2017.

(51) Int. Cl.

| | |
|---|---|
| ***A45C 9/00*** | (2006.01) |
| ***A45F 4/12*** | (2006.01) |
| *A45F 3/00* | (2006.01) |

(52) U.S. Cl.

CPC ..... *A45F 4/12* (2013.01); *A45C 9/00* (2013.01); *A45F 2003/002* (2013.01); *A45F 2003/006* (2013.01)

(58) Field of Classification Search

CPC ..... A45C 9/00; A45F 4/12; A45F 2003/002; A45F 2003/006

USPC ..... 150/106

See application file for complete search history.

(56) References Cited

U.S. PATENT DOCUMENTS

| | | | | |
|---|---|---|---|---|
| 5,214,802 | A * | 6/1993 | McCallum | A42B 1/006 2/209.12 |
| 5,996,121 | A * | 12/1999 | Harris | A41D 15/04 2/108 |
| 6,817,031 | B1 * | 11/2004 | Gravlin | A41D 1/00 2/67 |
| 10,588,362 | B1 * | 3/2020 | Alexei | A45C 9/00 |
| 2009/0055991 | A1 * | 3/2009 | Johnson | A41D 1/04 2/84 |
| 2009/0055995 | A1 * | 3/2009 | Garza | A42B 1/006 2/209.11 |
| 2010/0111448 | A1 * | 5/2010 | Li | A45C 9/00 383/4 |
| 2012/0152772 | A1 * | 6/2012 | Garner | A45F 4/12 206/223 |
| 2014/0251515 | A1 * | 9/2014 | Hansen | A45C 3/08 150/113 |

(Continued)

*Primary Examiner* — Sue A Weaver

(74) *Attorney, Agent, or Firm* — Monarch IP Group, PLLC; April M. Mosby

(57) ABSTRACT

A convertible tote bag assembly is provided. The tote bag includes an exterior housing that is an article of clothing having fastening members. An interior panel may be seated and coupled within the exterior housing, wherein the exterior housing is wrapped around the interior panel to engage the fastening members in a closed manner. A strap may be coupled to the exterior housing, wherein when the interior panel and the strap are removed from the exterior housing, the exterior housing converts into a wearable article of clothing, such as a shirt, blouse, or a pair of slacks. In some embodiments, the exterior housing may include at least one pair of sleeves coupled to a bodice, wherein the strap is slidably positioned through the pair of sleeves. The bodice may include an opening defining a neckline, such that the exterior housing may be worn as clothing.

14 Claims, 10 Drawing Sheets

(56) References Cited

U.S. PATENT DOCUMENTS

| | | | | |
|---|---|---|---|---|
| 2015/0090757 | A1* | 4/2015 | Lin | A42B 1/006 224/577 |
| 2015/0101720 | A1* | 4/2015 | Lee | A45F 3/02 150/106 |
| 2015/0150319 | A1* | 6/2015 | Walmsley | A41D 15/04 2/69.5 |

* cited by examiner

CONVERTIBLE TOTE BAG ASSEMBLY AND METHOD THEREOF

CROSS REFERENCE TO RELATED APPLICATIONS

This present application relates to commonly-owned U.S. patent application Ser. No. 62/592,176, entitled "A Convertible Tote Bag Assembly," naming April L. Cantrell as the inventor, filed Nov. 29, 2017, which is provisional application of which the present application is entitled to the benefit of the filing date; the contents of which are incorporated by herein by reference in its entirety.

BACKGROUND

Garment and tote bags in the garment industry are typically used for carrying and storing items. A great variety of garment and tote bags currently exist. Some bags, with and without fastened openings, are smaller in dimension. These may or may not include handles (i.e. handbags). Some can be easily carried across the shoulder to hang on one side of the body (e.g. shoulder bags), while others can be carried across the back, wherein the bag is strapped to both shoulders and is seated in the center of the back (e.g. backpacks). There are even bags that can be worn over one shoulder with a strap that goes across the chest resting the bag on the lower back (i.e. messenger bags). These bags can be made of a leather or cloth material and can be used to house and store a variety of different items. People who transport personal items from place to place commonly use any number of the bags mentioned previously. For example, a person can use a tote bag to store various articles of clothing and other personal grooming items, when they go out or travel. However, at some point when the user has nothing to store in the bag, carrying and storing the empty bag can be troublesome when a person is traveling.

Most, if not all, of these bags generally have only one function. They do not have multiple uses. Therefore, if a person does not need the function of carrying or storing items, the bag wastes space and is cumbersome. For example, when a person is biking or hiking, they need a bag that can be used for a variety of purposes, not just solely for caring and storing items. Further, some bags are excessive in weight and may consequently cause damage the back, neck and/or shoulder.

It is within this context that the embodiments arise.

SUMMARY

Embodiments of a convertible tote bag assembly are provided. It should be appreciated that the present embodiment can be implemented in numerous ways, such as a process, an apparatus, a system, a device, or a method. Several inventive embodiments are described below.

In some embodiments, a tote bag that is convertible into multiple wearable articles of clothing is provided. The tote bag may include an exterior housing, having fastening members. An interior panel may be seated within the exterior housing, wherein the exterior housing is wrapped around the interior panel to engage the fastening members in a closed manner. A strap may be coupled to the exterior housing, wherein when the interior panel and the strap are removed from the exterior housing, the exterior housing converts into a wearable article of clothing, such as a shirt, blouse, or a pair of slacks. In one embodiment, the exterior housing may include at least one pair of sleeves coupled to a bodice, wherein the strap is slidably positioned through the pair of sleeves. The bodice may also include an opening defining a neckline, such that the exterior housing may be worn as clothing. Each component of the assembly can have multiple purposes. The interior panel and the strap can also be worn. For example, when the strap is made of leather, the strap may be worn as a belt. In contrast, when the strap is made of fabric, it can serve as a scarf or a baby holster. The interior panel may include detachable pockets, wherein the panel can be converted into a towel for drying the body. Alternatively, the panel may be worn as a shawl having a hood, wherein the hood is formed by at least one pocket.

In some embodiments, the convertible tote bag may include an exterior housing, having fastening members. An interior panel may be seated within the exterior housing, wherein the exterior housing is wrapped around the interior panel to engage the fastening members in a closed manner. The exterior housing may include a pair of long sleeves may be coupled to a bodice, such that the pair of sleeves coupled together to form straps of the tote bag. The bodice may also include an opening defining a neckline, such that the exterior housing may be worn as clothing. For example, when the pair of fastening members are uncoupled, the interior section can be slidably removed from the exterior housing, and the pair of sleeves can be uncoupled, such that the exterior housing converts into a wearable article of clothing, such as a long-sleeved shirt.

In some embodiments, the convertible tote bag may include an exterior housing, having fastening members. An interior panel may be seated within the exterior housing, wherein the exterior housing is wrapped around the interior panel to engage the fastening members in a closed manner. The exterior housing may include a pair of pant legs, such that the pair of pant legs coupled together to form straps of the tote bag. The pair of pant legs may coupled to a waistband bodice at a top portion, such that the exterior housing may be worn as a pair of pants. For example, when the pair of fastening members are uncoupled, the interior section can be slidably removed from the exterior housing, and the pair of pant legs can be uncoupled, such that the exterior housing converts into a wearable article of clothing, such as pants.

In some embodiments, a method for assembling and converting the convertible tote bag assembly into wearable apparel is provided. In one embodiment, the method for assembling may include compressing an interior panel. For example, the interior panel may be folded and rolled to fit within a bodice portion of an exterior housing of the convertible tote bag assembly. In the alternative, the interior panel may be folded back and forth in an accordion fashion. The method may also include inserting the compressed interior panel within the exterior housing. Further, the method can include inserting a shoulder strap within the exterior housing, such that the strap is positioned inside and outside of the exterior housing. The method in accordance with some embodiments may include wrapping the exterior housing around the interior panel. For example, the exterior housing may be folded and rolled over the interior panel to form a package. Further, the method may include sealing at least one pair of fastening members coupled to the exterior housing to form a closed assembly.

In some embodiments, the method for converting the convertible tote bag assembly may include unfastening a sealed enclosure of an exterior housing of the convertible tote bag assembly, wherein the exterior housing including an interior panel and a shoulder strap. The method for converting the tote bag can also include removing the interior panel and the shoulder strap from the exterior housing. Further, the method for converting the tote bag may include placing the exterior housing on the body. For example, the exterior housing may comprise a bodice and at least one pair of sleeves, such that a person can slip the exterior housing on after removing the interior panel and shoulder strap. In the alternative, the exterior housing may comprise a pair of short pant legs that couple together with a waist band, such that a person can slip on the exterior housing as a pair of shorts, when the strap and the interior panel are removed.

Other aspects and advantages of the embodiments will become apparent from the following detailed description taken in conjunction with the accompanying drawings which illustrate, by way of example, the principles of the described embodiments.

BRIEF DESCRIPTION OF THE DRAWINGS

The described embodiments and the advantages thereof may best be understood by reference to the following description taken in conjunction with the accompanying drawings. These drawings in no way limit any changes in form and detail that may be made to the described embodiments by one so skilled in the art without departing from the spirit and scope of the described embodiments.

DETAILED DESCRIPTION

Figure 1:
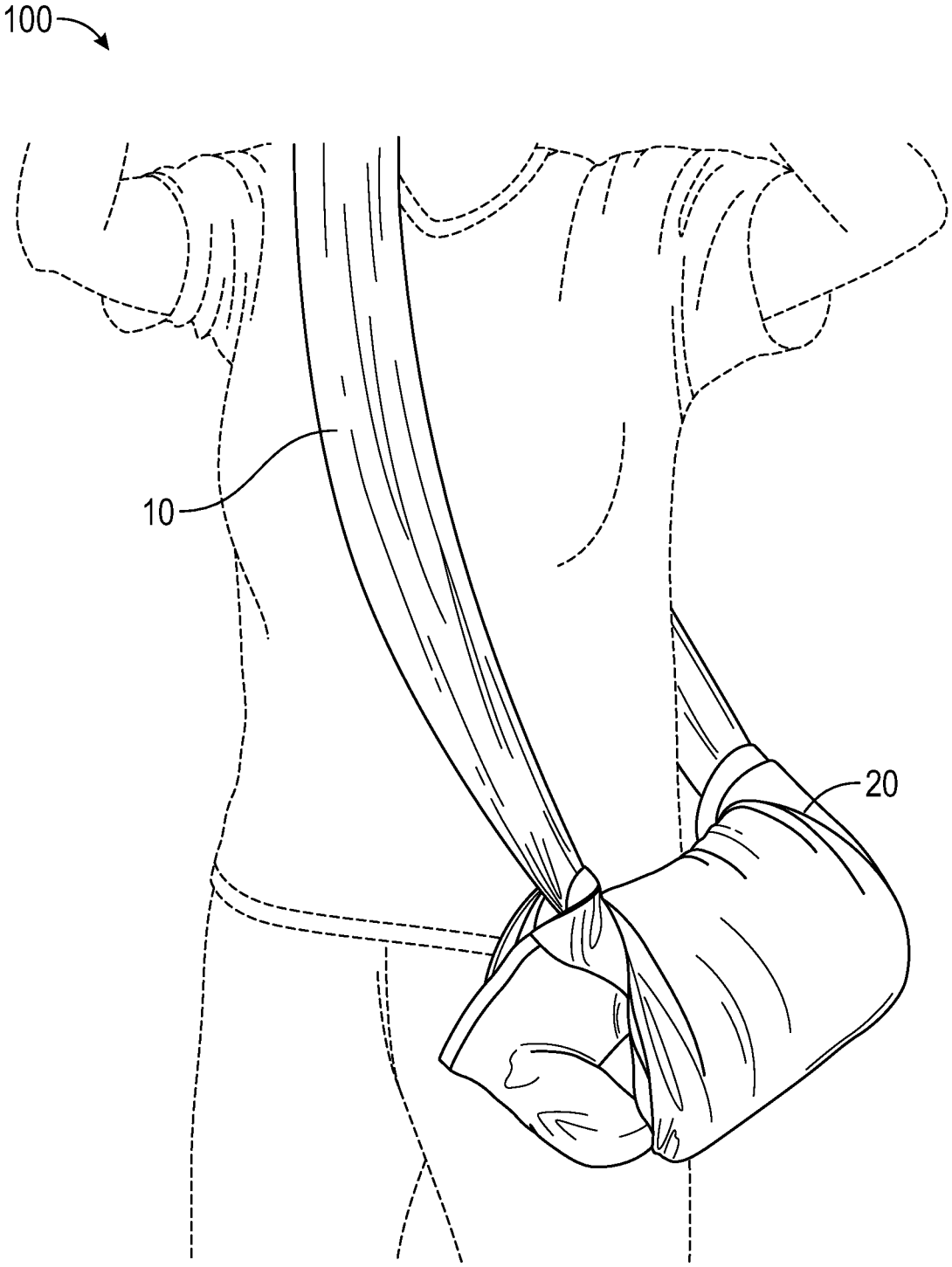
FIG. 1 is a perspective view of a convertible tote bag assembly, in accordance with some embodiments.

The following embodiments describe a convertible tote bag assembly. It can be appreciated by one skilled in the art, that the embodiments may be practiced without some or all of these specific details. In other instances, well known process operations have not been described in detail in order not to unnecessarily obscure the embodiments. Although specific embodiments of the convertible tote bag assembly will now be described, it should also be understood that these embodiments are examples only and merely illustrate a small number of the many possible specific embodiments that can represent application of the principles of the invention. Various changes and modifications obvious to one skilled in the art, to which the present assembly pertains, are deemed to be within the spirit, scope and contemplation of the present invention as further defined in the claims.

The convertible tote bag assembly may include an exterior housing, having fastening members. An interior panel may be seated within the exterior housing, wherein the exterior housing is wrapped around the interior panel to engage the fastening members in a closed manner. A strap may be coupled to the exterior housing, wherein when the interior panel and the strap are removed from the exterior housing, the exterior housing converts into a wearable article of clothing, such as a shirt, blouse, or a pair of slacks. In one embodiment, the exterior housing may include at least one pair of sleeves coupled to a bodice, wherein the strap is slidably positioned through the pair of sleeves. The bodice may also include an opening defining a neckline, such that the exterior housing may be worn as clothing. Each component of the assembly can have multiple purposes. The interior panel and the strap can also be worn. For example, when the strap is made of leather, the strap may be worn as a belt. In contrast, when the strap is made of fabric, it can serve as a scarf or a baby holster. The interior panel may include detachable pockets, wherein the panel can be converted into a towel for drying the body. Further, the pockets may, for example, hold hiking, biking, or camping supplies. Alternatively, the panel may be worn as a shawl having a hood, wherein the hood is formed by at least one pocket. In some embodiments, the interior panel may be a yoga mat for exercise.

In some embodiments, the convertible tote bag may include an exterior housing, having fastening members. An interior panel may be seated within the exterior housing, wherein the exterior housing is wrapped around the interior panel to engage the fastening members in a closed manner. The exterior housing may include a pair of long sleeves coupled to a bodice, such that the pair of sleeves coupled together to form straps of the tote bag. The bodice may also include an opening defining a neckline, such that the exterior housing may be worn as clothing. For example, when the pair of fastening members are uncoupled, the interior section can be slidably removed from the exterior housing, and the pair of sleeves can be uncoupled, such that the exterior housing converts into a wearable article of clothing, such as a long-sleeved shirt.

Advantageously, the tote bag assembly is compact and converts into to several objects that may be worn as the tote bag around the shoulder or various articles of clothing. The traveler may enjoy the use of the assembly whether storing items, carrying items, or wearing the assembly. There is no longer any wasted space. The tote bag assembly may be used during hiking, biking, traveling, commuting and the like, wherein the pockets may hold supplies for medical, hiking, biking, survival, yoga needs and the like. The bag is lightweight and thereby does not cause bodily injury.

In the following description, numerous details are set forth. It will be apparent, however, to one skilled in the art, that the present invention may be practiced without these specific details.

Reference in the description to "one embodiment" or "an embodiment" means that a particular feature, structure, or characteristic described in connection with the embodiment is included in at least one embodiment of the invention. The phrase "in one embodiment" located in various places in this description does not necessarily refer to the same embodiment. Like reference numbers signify like elements throughout the description of the figures.

Figure 2:
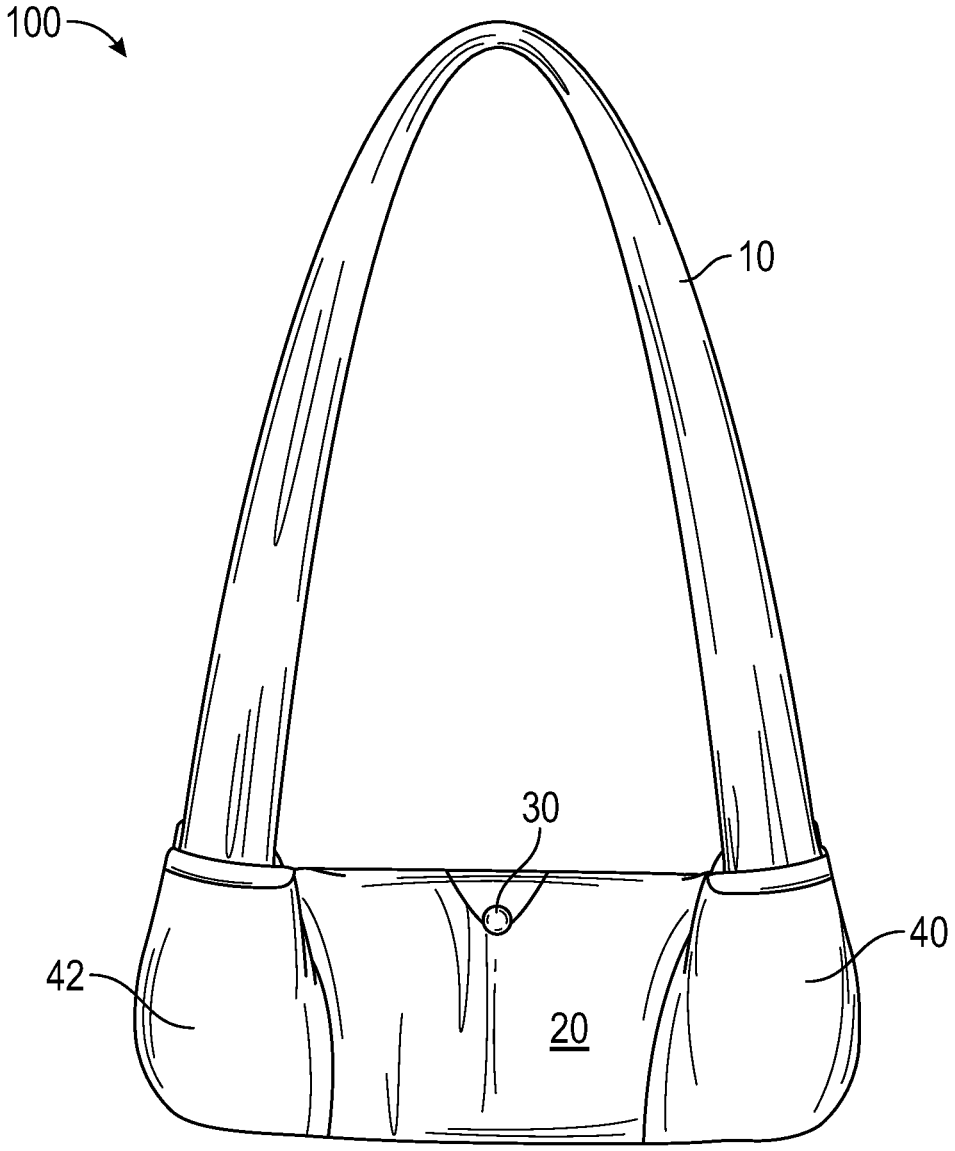
FIG. 2 is a front elevation view of the convertible tote bag assembly in some embodiments.
Figure 3:
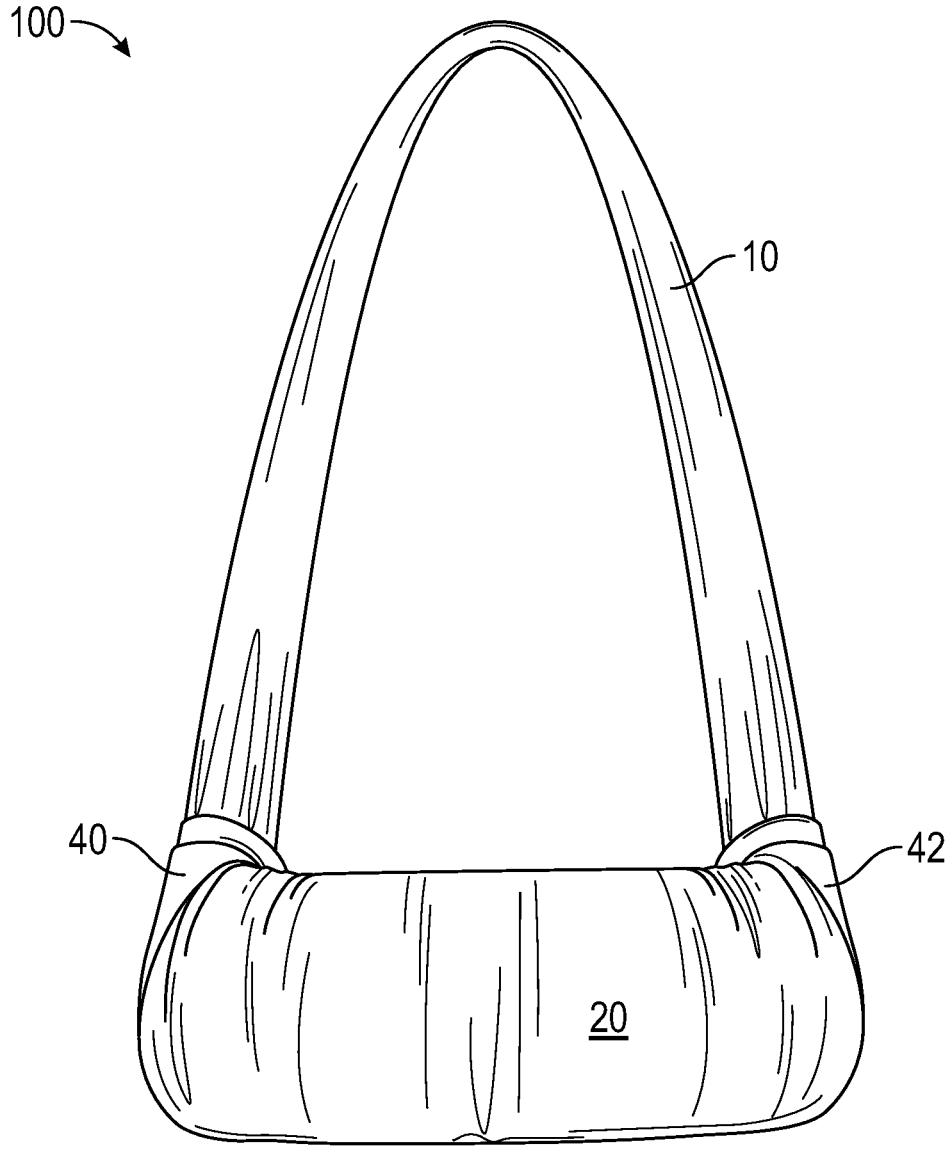
FIG. 3 is a rear elevation view of the convertible tote bag assembly in accordance with some embodiments.
Figure 4:
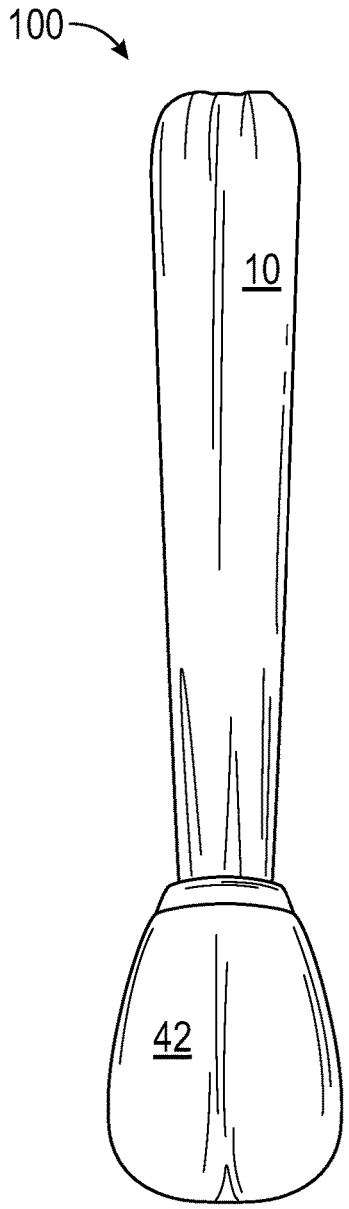
FIG. 4 is a left-side elevation view of the convertible tote bag assembly in accordance with some embodiments, the right-side elevation being a mirror image thereof.
Figure 5:
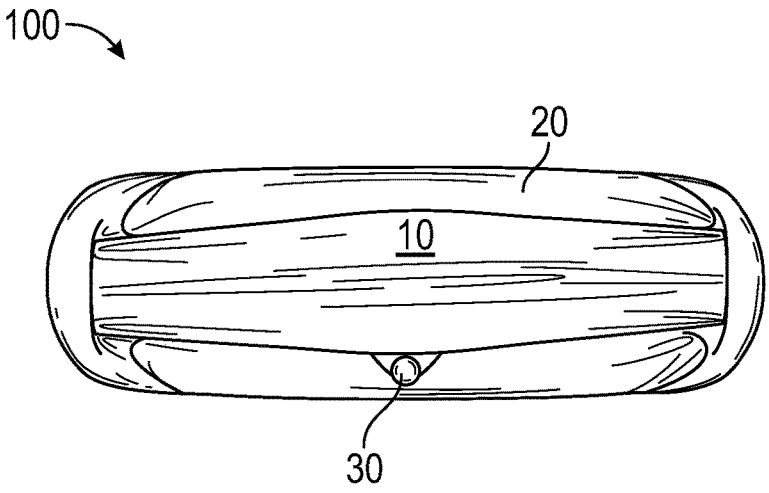
FIG. 5 is a top plane view of the convertible tote bag assembly in accordance with some embodiments.
Figure 6:
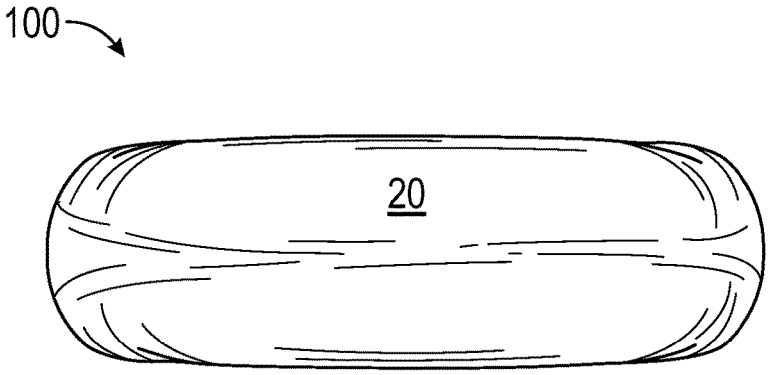
FIG. 6 is a bottom plane view of the convertible tote bag assembly in accordance with some embodiments.

Referring to FIG. 1, an exemplary embodiment of the tote bag assembly 100 is shown. The tote bag assembly 100 may include an exterior housing 20, having fastening members 30 as shown in FIG. 2, which represents the front elevation view of the convertible tote bag assembly 100. The fastening members 30 may include male/female snap fastening members, buttons, zippers, draw string, concealed magnetic snaps, mechanically affixing snaps, buckles, claps, clips, hook and eye components, VELCRO® closure members, different types of adhesive members, and the like. The exterior housing 20 may include at least a pair of sleeves (40, 42). The strap 10 may be insertably, removable from within the exterior housing 20. Further, with reference to FIG. 3, a rear elevation view of the convertible tote bag assembly 100 in accordance with some embodiments is illustrated. As shown, the strap 10 couples through the exterior housing 20. In the alternative, the strap 10 may be coupled to the exterior housing using a variety of fastening members (not shown). Referring to FIG. 4, a left-side elevation view of the convertible tote bag assembly 100 in accordance with some embodiments is displayed, the right-side elevation being a mirror image of the same. FIGS. 5 and 6 illustrate both the top and bottom plane views of the tote bag assembly 100, respectively.

Figure 7:
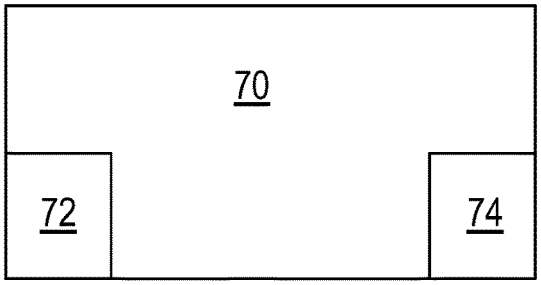
FIG. 7 is an illustration of one embodiment of the interior panel having pockets which may implement the embodiments of the assembly described herein.
Figure 8:
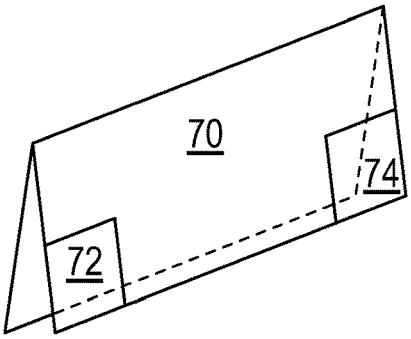
FIG. 8 is an illustration of the interior panel of FIG. 7 folded in half in some embodiments of the assembly described herein.
Figure 9:
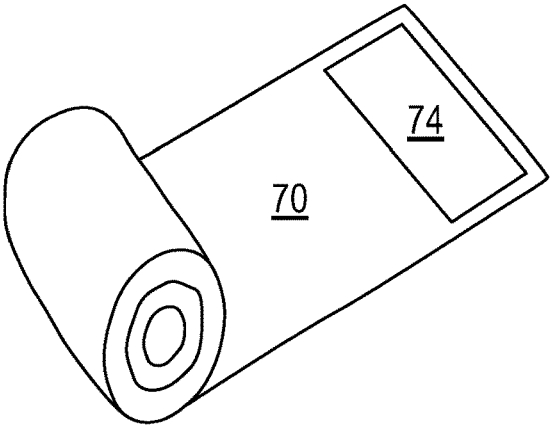
FIG. 9 is an illustration of the interior panel of FIG. 8 partially rolled in some embodiments of the tote bag assembly described herein.
Figure 10:
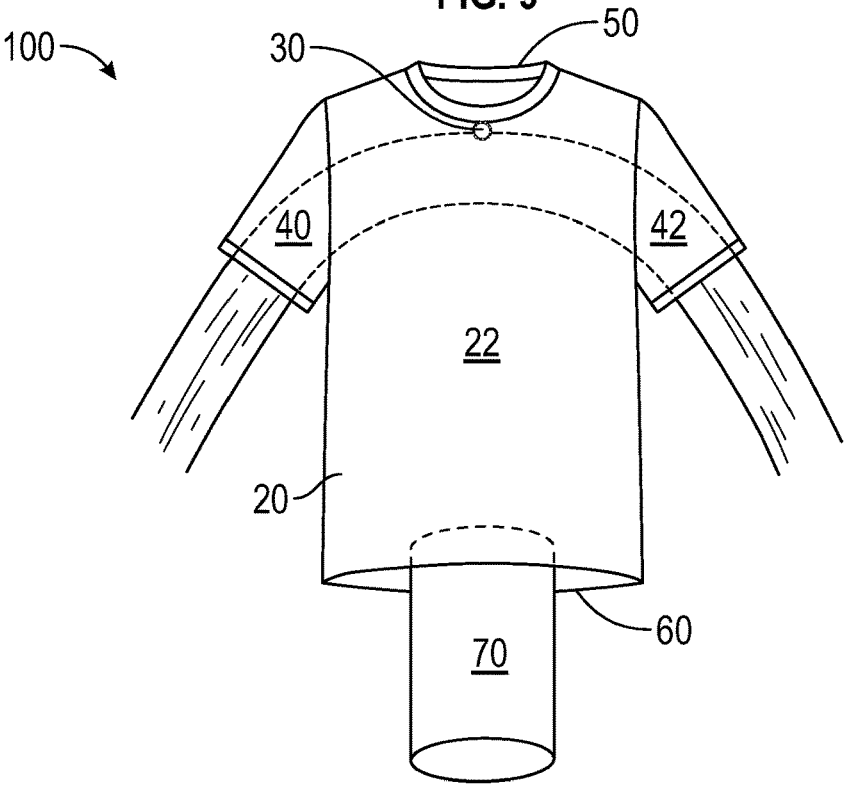
FIG. 10 displays how the interior panel and strap may be assembled within the exterior housing in some embodiments of the tote bag assembly described herein.
Figure 11:
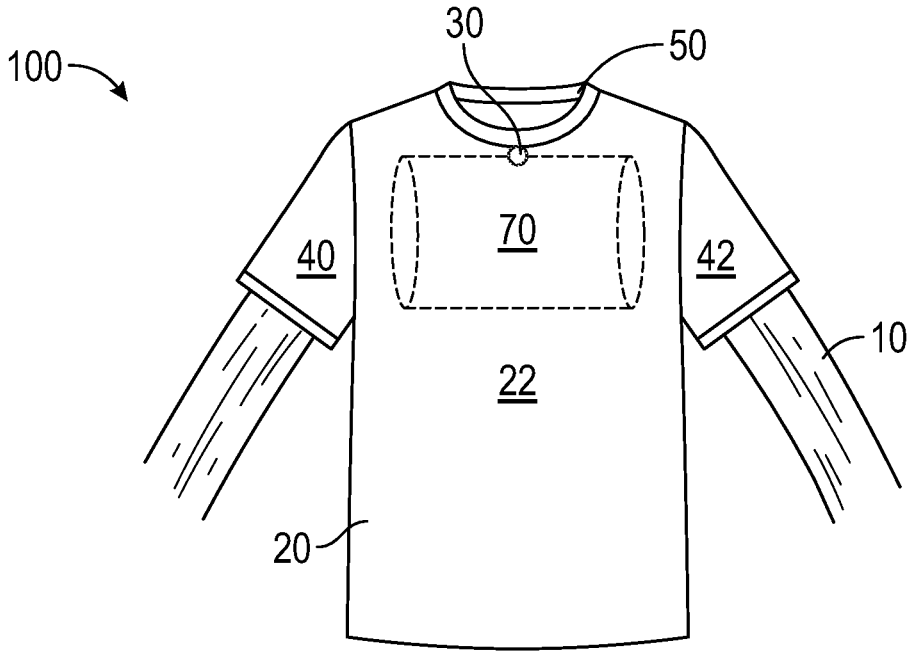
FIG. 11 illustrates the placement of the interior panel in the exterior housing in accordance with some embodiments.

In some embodiments as shown in FIG. 10, the interior panel 70 may be seated within the exterior housing 20 through opening 60, whereby the exterior housing 20 is wrapped around the interior panel 70 to engage the fastening members 30 in a closed manner, as will be described more in detail below with reference to FIGS. 11-14. In particular, as shown in FIG. 7, the interior panel 70 may include at least one pocket (72, 74). Although the interior panel 70 is shown as a rectangular panel, the interior panel may be circular, elliptical, triangular, or any variety of shapes. For some embodiments in preparation to be inserted with the exterior housing 20, the interior panel 70 may be folded as shown in FIG. 8 and rolled into a cylinder as shown in FIG. 9. In the alternative, interior panel 70 may be folded in an accordion pattern (not shown). In some embodiments, the strap 10 may be coupled to the exterior housing 20 using fastening members (not shown). When the interior panel 70 and the strap 10 are removed or decoupled from the exterior housing 20, the exterior housing 20 can convert into a wearable article of clothing, such as a shirt, blouse, or a pair of slacks.

Figure 18:
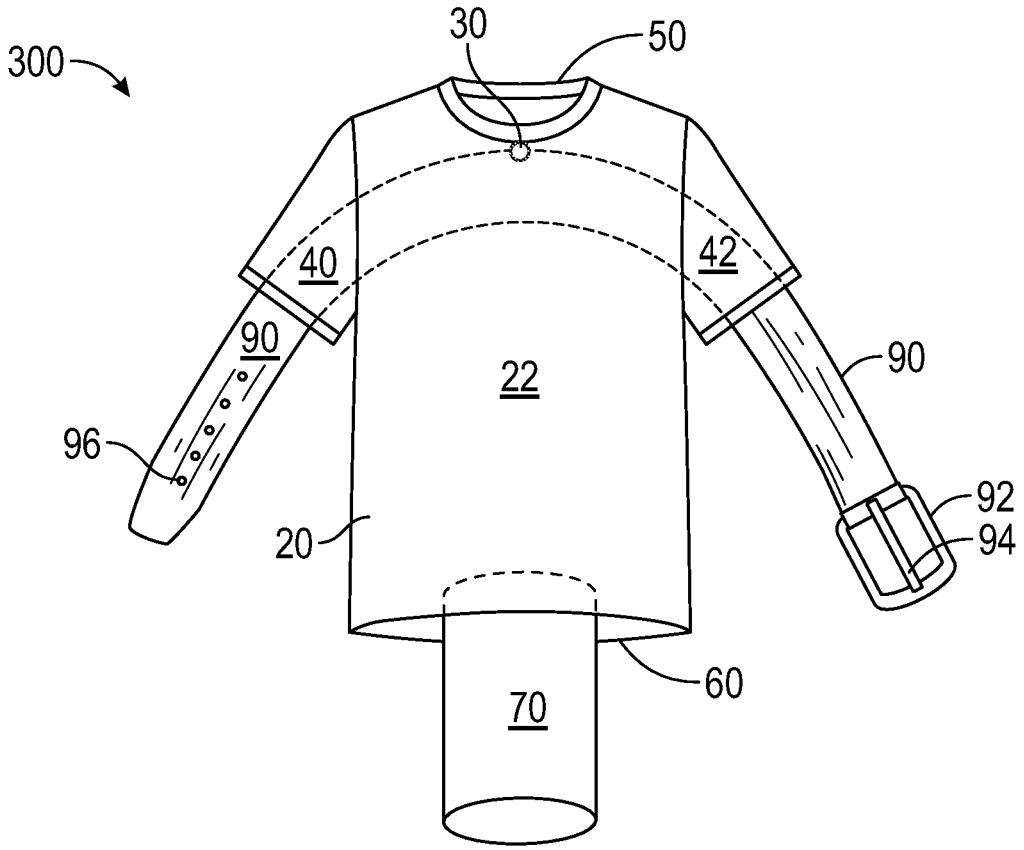
FIG. 18 illustrates the placement of the interior panel in the exterior housing, wherein a leather belt is inserted through a first and second opening of the exterior housing, in accordance with some embodiments.

In some embodiments, as shown in FIG. 10, the exterior housing 20 may include at least one pair of sleeves (40, 42) coupled to a bodice 22, wherein the strap 10 is slidably positioned through the pair of sleeves (40, 42). The bodice 22 may also include an opening 50 defining a neckline and an opening 60 defining the waist band, such that the exterior housing 20 may be worn as clothing. Each component of the assembly can have multiple purposes. The interior panel 70 and the strap 10 can also be worn. For example, when the strap 10 is made of leather, the strap 10 may be worn as a belt. More particularly, a leather belt 90 having a buckle 92, latch pin 94 and recesses 96 within can be used as the strap as shown in FIG. 18. In contrast, when the strap 10 is made of fabric, it can serve as a scarf or a baby holster. The interior panel 70 may include detachable pockets (72, 74), wherein the panel 70 can be converted into a towel for drying the body and the pockets can be detached from the panel 70 to function as a wash cloth; wherein, both the panel and pockets are made of terry cloth material, cotton, synthetic or some other soft, absorbent fabric. Alternatively, the panel 70 may be worn as a shawl having a hood, wherein the hood is formed by at least one pocket (72, 74).

In some embodiments, the convertible tote bag assembly 100 may include an exterior housing, having a pair of long sleeves (not shown) coupled to a bodice, such that the pair of sleeves coupled together to form straps of the tote bag. The bodice may also include an opening defining a neckline, such that the exterior housing may be worn as clothing. For example, when pair of fastening members are uncoupled, the interior panel can be slidably removed from the exterior housing, and the pair of sleeves can be uncoupled, such that the exterior housing converts into a wearable article of clothing, such as a long-sleeved shirt (not shown).

In some embodiments, the convertible tote bag assembly 100 may include an exterior housing having a pair of short pant legs (not shown) coupled to a waistband opening; wherein, the strap 10 is insertably positioned within the legs of the exterior housing. Accordingly, the exterior housing converts into a pair of shorts that can be worn as an article of clothing.

In some embodiments, the construction of tote bag is cloth, with a variety of cloth products known in the apparel industry to be preferable, including but not limited to cotton, cotton-poly blends, polyester, nylon, canvas, natural, synthetic woven textiles and the like. Other desirable construction materials include but are not limited to denim, corduroy, washable suede, leather, suede, fur, and faux fur.

Figure 12:
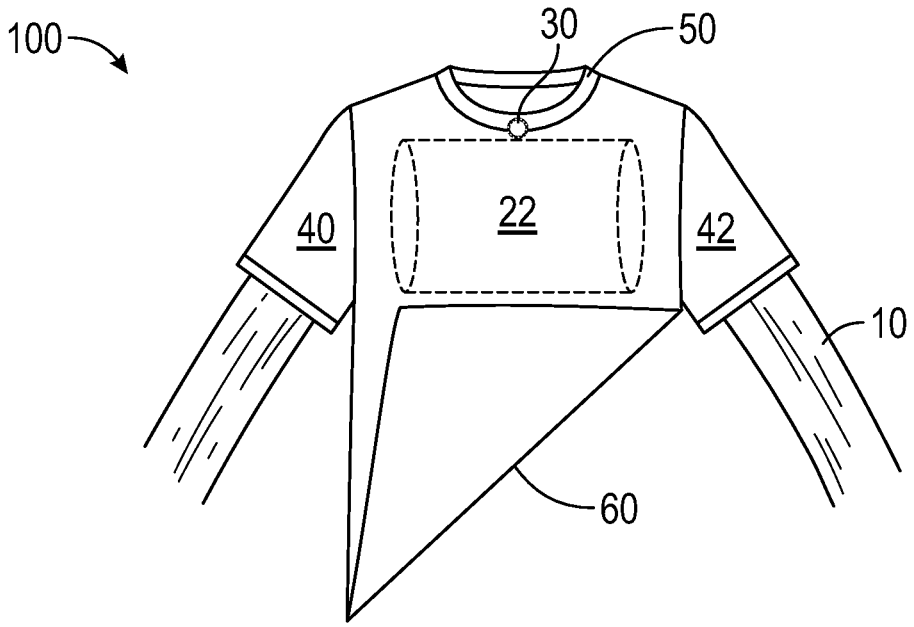
FIG. 12 displays the first folding of the exterior housing around the interior panel in accordance with some embodiments.
Figure 13:
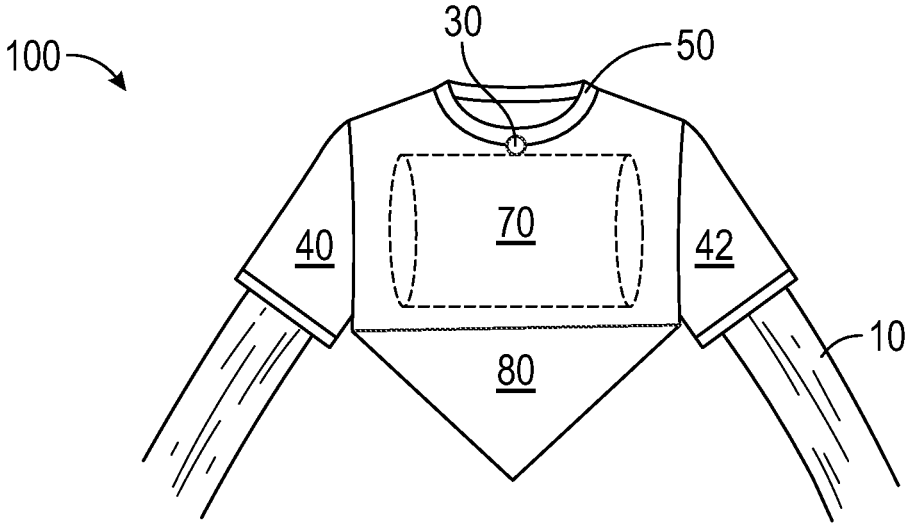
FIG. 13 displays a second folding of the exterior housing around the interior panel in accordance with some embodiments.
Figure 14:
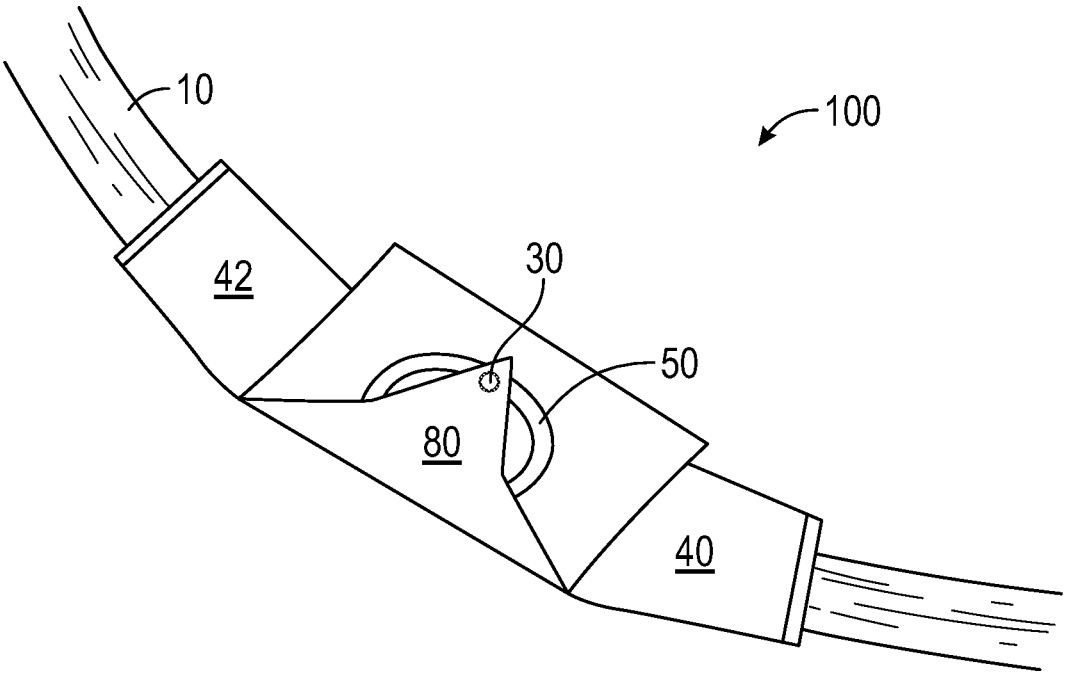
FIG. 14 displays a closed position of the banded enclosure of the exterior housing in accordance with some embodiments.

In operation, as shown in FIGS. 11-14, the strap 10 may be inserted through sleeves (40, 42) of exterior housing 20 through opening 60, having a bodice 22. The interior panel 70 may be compressed into a size that approximate fits within the cavity formed by the bodice of the exterior housing 20. For example, the interior panel can be rolled into a cylindrical column, which may be inserted within the exterior housing 20 to be juxtapose the neckline opening 50 of the exterior housing 20. In the alternative, the interior panel 70 can be folded in an accordion pattern and inserted within the exterior housing 20 to be juxtapose the neckline opening 50 of the exterior housing 20. In some embodiments, as shown in FIG. 12, the bodice of the exterior housing 20 may be folded once and then again as shown in FIG. 13, such that a folded corner portion 80 remains. This folded corner portion 80 may be wrapped around the remainder portion of the exterior housing 20, as shown in FIG. 14. A fastening member 30 may couple to a recess (not shown) within the folded corner portion 80 to form a sealed enclosure.

In some embodiments, during the conversion process of the tote bag assembly into wearable apparel, the sealed enclosure may be unfastened and the exterior housing 20 may be unwrapped to reveal the interior panel 70. Next, the interior panel 70 may be removed from the exterior housing 20. The exterior housing 20 may be placed upon the body after the interior panel 70 and the strap 10 are removed. For example, when the exterior housing 20 comprises a bodice and at least one pair of sleeves (whether long or short), the exterior housing 20 converts into a shirt or a blouse. When the exterior housing 20 comprises a bodice and at least a pair of short pant legs, the exterior housing 20 converts into a pair of shorts.

Figure 15:
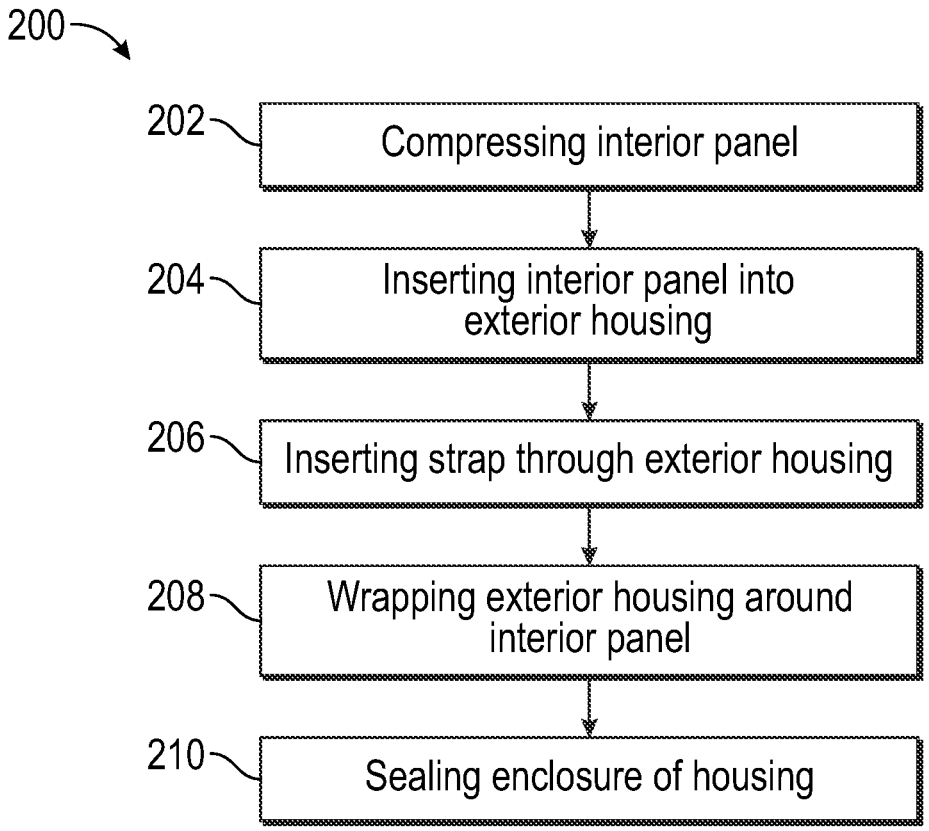
FIG. 15 is a flowchart diagram of a method for assembling a convertible tote bag assembly in accordance with some embodiments.
Figure 16:
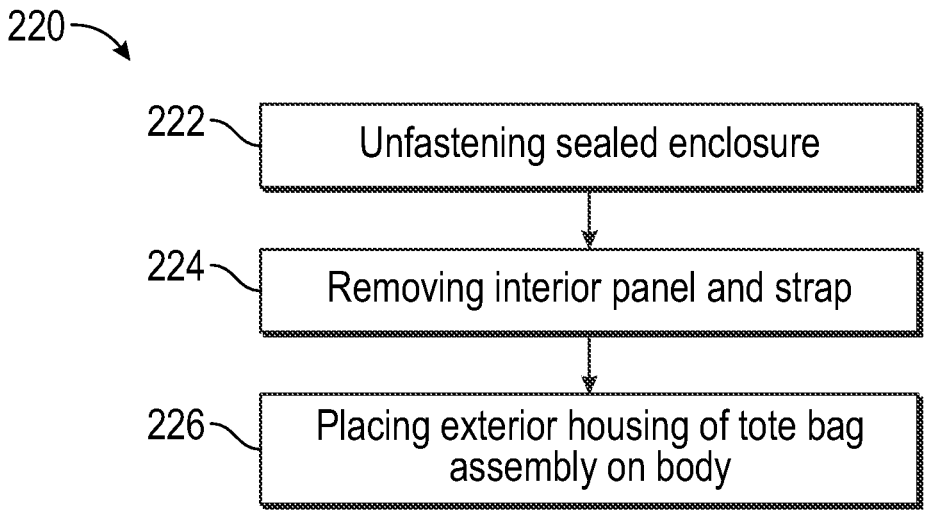
FIG. 16 is a flowchart diagram of a method for converting a convertible tote bag assembly into wearable apparel in accordance with some embodiments.

Now referring to FIGS. 15 and 16, an exemplary flow diagram of a method of assembling and disassembling the convertible tote bag assembly in accordance with some embodiments is provided. In some embodiments, a method 200 for assembling and converting the convertible tote bag assembly into wearable apparel may include compressing an interior panel in an action 202. For example, the interior panel may be folded and rolled to fit within a bodice portion of an exterior housing of the convertible tote bag assembly. In the alternative, the interior panel may be folded back and forth in an accordion fashion. In an action 204, the method may also include inserting the compressed interior panel within the exterior housing. Further in an action 206, the method can include inserting a shoulder strap within the exterior housing, such that the strap is positioned inside and outside of the exterior housing. The method in accordance with some embodiments may include wrapping the exterior housing around the interior panel, in an action 208. For example, the exterior housing may be folded and rolled over the interior panel to form a package. Further, the method may include sealing at least one pair of fastening members coupled to the exterior housing to form a closed assembly in an action 210.

Turning to FIG. 16, the method 220 for converting the convertible tote bag assembly may include unfastening a sealed enclosure of an exterior housing of the convertible tote bag assembly, wherein the exterior housing including an interior panel and a shoulder strap, in an action 222. In an action, 224, the method for converting the tote bag can also include removing the interior panel and the shoulder strap from the exterior housing. Further, the method for converting the tote bag may include placing the exterior housing on the body, in an action 226. For example, the exterior housing may comprise a bodice and at least one pair of sleeves, such that a person can slip the exterior housing on after removing the interior panel and shoulder strap. In the alternative, the exterior housing may comprise a pair of short pant legs that couple together with a waist band, such that a person can slip on the exterior housing as a pair of shorts, when the strap and the interior panel are removed.

Figure 17A:
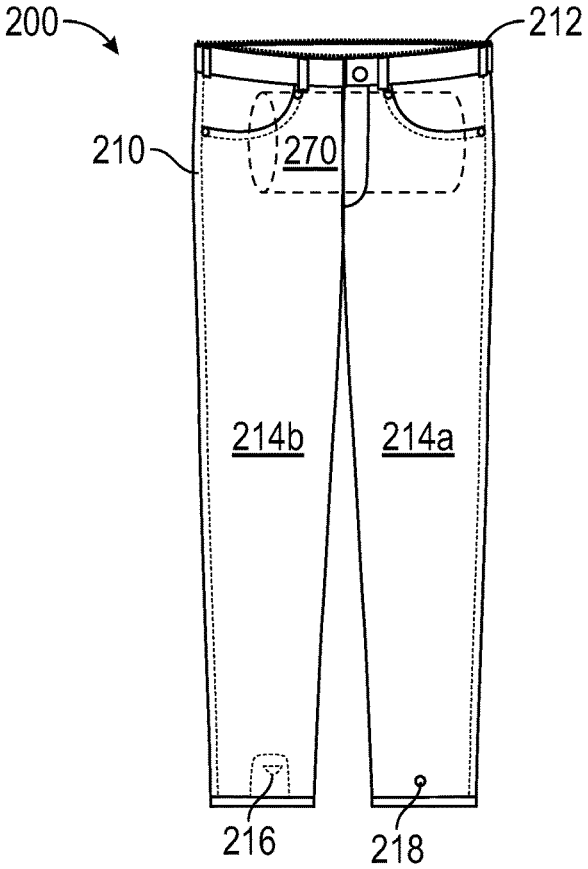
FIG. 17A illustrates the placement of the interior panel in the exterior housing, having a pair of pant legs, in accordance with some embodiments.
Figure 17B:
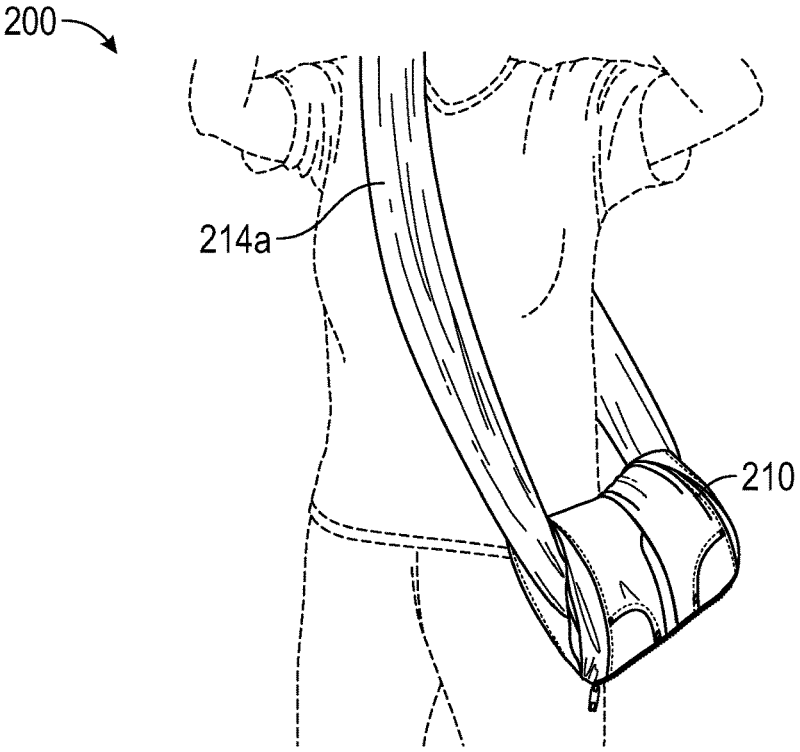
FIG. 17B is a perspective view of a convertible tote bag assembly, in accordance with some embodiments.

Referring to FIGS. 17A and 17B, In some embodiments, the convertible tote bag may include an exterior housing 200, having fastening members (212, 216, 218). In particular, an interior panel (270) may be seated within the exterior housing 210, wherein the exterior housing is wrapped around the interior panel 270 to engage the fastening member 212 in a closed manner. In some embodiments, fastening member 212 can be a zipper as shown in FIGS. 17A and 17B. The exterior housing can be pants 210, having a pair of pant legs (214*a*, 214*b*); such that the pair of pants legs (214*a*, 214*b*) can couple together to form the strap of the tote bag assembly. Specifically, fastening member 218 may couple to female receiving fastening member 216 located on the interior portion of pant leg 214*b*, such that the tote 200 can be worn around a person's shoulder as shown in FIG. 17B. The waistband bodice at a top portion of pair of pant legs may be uncoupled, such that the exterior housing may be worn as a pair of pants. For example, when the pair of fastening members 212 are uncoupled, the interior section 270 can be slidably removed from the exterior housing 210, and the pair of pant legs can be uncoupled (214*a*, 214*b*), such that the exterior housing 210 converts into a wearable article of clothing.

It is to be understood that the above description is intended to be illustrative, and not restrictive. Many other embodiments will be apparent to those of skill in the art upon reading and understanding the above description. Many modifications and variations are possible in view of the above teachings. The embodiments were chosen and described in order to best explain the principles of the embodiments and its practical applications, to thereby enable others skilled in the art to best utilize the embodiments and various modifications as may be suited to the particular use contemplated. Accordingly, the present embodiments are to be considered as illustrative and not restrictive, and the invention is not to be limited to the details given herein, but may be modified within the scope and equivalents of the appended claims. Although the present invention has been described with reference to specific exemplary embodiments, it will be recognized that the invention is not limited to the embodiments described, but can be practiced with modification and alteration within the spirit and scope of the appended claims. Accordingly, the specification and drawings are to be regarded in an illustrative sense rather than a restrictive sense. The scope of the invention should, therefore, be determined with reference to the appended claims, along with the full scope of equivalents to which such claims are entitled.

While certain novel features of this invention have been shown and described, it is not intended to be limited to the details above, since it will be understood that various omissions, modifications, substitutions and changes in the forms and details of the device illustrated and in its operation can be made by those skilled in the art without departing in any way from the spirit of the invention.

What is claimed is:

1. A tote bag, comprising:

an exterior housing, having a pair of fastening members, a first opening and a second opening, wherein the exterior housing is an article of clothing;

an interior panel seated within the exterior housing, wherein the exterior housing is wrapped around the interior panel to engage the pair of fastening members closed; and a strap seated within the exterior housing through the first opening and the second opening, wherein the first opening and the second opening provide support for the strap, wherein the strap is seated along the entire length of an interior surface of the exterior housing from the first opening to the second opening;

wherein when the interior panel and the strap are removed from the exterior housing, the exterior housing is wearable.

2. The tote bag of claim 1, wherein the exterior housing comprises, a bodice;

a pair of sleeves coupled to the bodice, wherein the strap is slidably positioned through the pair of sleeves;

wherein the bodice having an opening defining a neckline, such that the exterior housing is wearable.

3. The tote bag of claim 2, wherein the strap comprises, a scarf, wherein the scarf is slidably seated through the pair of sleeves;

wherein, when the scarf is removed from the exterior housing, the scarf is wearable as an article of clothing accessory.

4. The tote bag of claim 2, wherein the strap comprises, a wide panel, wherein the wide panel is foldably seated through the pair of sleeves;

wherein, when the strap is removed from the exterior housing, the wide panel is wearable as a baby holster.

5. The tote bag of claim 2, wherein the pair of sleeves are short and the strap couples through each sleeve.

6. The tote bag of claim 1, wherein the interior panel comprises, a base panel;

one or more fastening members coupled to the base panel; and one or more pockets coupled to a matching mate of the one or more fastening members, wherein the one or more fastening members are capable of coupling to each matching mate.

7. The tote bag of claim 6, wherein the base panel is selected from a group consisting of cotton, nylon, silk, polyester, denim, wool, leather, plastic, rubber, wood, and metal.

8. The tote bag of claim 1, wherein the exterior housing is selected from a group consisting of cotton, nylon, silk, polyester, denim, wool, and leather.

9. The tote bag of claim 1, wherein the strap comprises, an elongated leather base, having one or more recesses at a first end; and a buckle, having a latch pin, coupled to a second end of the leather belt;

wherein when the strap is slidably placed and secured within the exterior housing through the first opening and the second opening, the latch pin of the second end inserts through the one or more recesses of the first end, wherein when the strap is removed from the exterior housing, the strap is wearable as an article of clothing accessory.

10. A tote bag comprising:

an exterior housing, having a pair of fastening members, wherein the exterior housing is an article of clothing; and an interior panel coupled to the exterior housing, wherein the exterior housing is wrapped around the interior panel to engage the pair of fastening members to close;

wherein, the exterior housing comprises a pair of pant legs;

a second pair of fastening members coupled to a respective one of the pair of pant legs, such that the pair of pant legs are capable of coupling together to form a strap of the tote bag;

wherein, when the pair of fastening members are uncoupled, the interior panel is slidably removed from the exterior housing, and the pair of pant legs are uncoupled, the exterior housing is wearable as an article of clothing.

11. The tote bag of claim 10, wherein the interior panel comprises, a base panel;

one or more fastening members coupled to the base panel; and one or more pockets coupled to a matching mate of the one or more fastening members, wherein the one or more fastening members are capable of coupling to each matching mate.

12. The tote bag of claim 11, wherein the base panel is selected from a group consisting of cotton, nylon, silk, polyester, denim, wool, leather, plastic, rubber, wood, and metal.

13. The tote bag of claim 11, the exterior housing is selected from a group consisting of cotton, nylon, silk, polyester, denim, wool, and leather.

14. A method of assembling a convertible tote bag assembly, the method comprising:

compressing an interior panel;

inserting the interior panel into an exterior housing;

inserting a strap within the exterior housing, such that the strap is positioned inside and outside of the exterior housing;

wrapping the exterior housing around the interior panel; and sealing at least one pair of fastening members coupled to the exterior housing to form a closed assembly.

* * * * *